US005877594A

United States Patent [19]

Miyano et al.

[11] Patent Number: 5,877,594

[45] Date of Patent: Mar. 2, 1999

[54] ELECTRON BEAM APPARATUS HAVING AN ELECTRON LENS AND A STRUCTURE FOR COMPENSATING FOR A SPHERICAL ABERRATION OF THE ELECTRON LENS

[75] Inventors: Soichiro Miyano; Akihiko Okamoto, both of Tokyo, Japan

[73] Assignee: NEC Corporation, Tokyo, Japan

[21] Appl. No.: 851,033

[22] Filed: May 5, 1997

[30] Foreign Application Priority Data

May 8, 1996 [JP] Japan ..... 8-113310

[51] Int. Cl.[6] ..... H01J 29/62

[52] U.S. Cl. ..... 315/169.1; 313/497; 315/382; 345/74

[58] Field of Search ..... 315/382, 382.1, 315/169.1, 169.3; 313/309, 336, 351, 495, 496, 497; 345/74, 75

[56] References Cited

U.S. PATENT DOCUMENTS

| | | | |
|---|---|---|---|
| 5,191,217 | 3/1993 | Kane et al. | 315/169.1 X |
| 5,528,103 | 6/1996 | Spindt et al. | 313/336 X |
| 5,552,659 | 9/1996 | Macaulay et al. | 313/309 X |

FOREIGN PATENT DOCUMENTS

| | | |
|---|---|---|
| 50-146264 | 11/1975 | Japan . |
| 52-18547 | 5/1977 | Japan . |
| 5-242794 | 9/1993 | Japan . |
| 5-266806 | 10/1993 | Japan . |
| 5-343000 | 12/1993 | Japan . |
| 7-85812 | 3/1995 | Japan . |

OTHER PUBLICATIONS

Kesling et al., "Beam Focusing for Field–Emission Flat–panel Displays", IEEE Transactions on Electron Devices, vol. 42, No. 2, pp. 340–347, Feb. 1995.

C.A. Spindt, "A Thin–Film Field–Emission Cathode", *Journal of Applied Physics,* vol. 39, No. 7, 1968, pp. 3504–3505.

*Primary Examiner*—Robert Pascal
*Assistant Examiner*—Justin P. Bettendorf
*Attorney, Agent, or Firm*—Sughrue, Mion, Zinn, Macpeak & Seas, PLLC

[57] ABSTRACT

In a cold cathode electron beam device, groups of electron emission cones emit electrons which are extracted from the cones by respective extraction electrodes. The emitted electrons are focussed into a beam by an electron lens so as to strike a fluorescent screen. In order to minimize the size of the beam spot where the beam strikes the screen, a structure is included which compensates for a spherical aberration property which is inherent to the electron lens. The spherical aberration is compensated for by placing a focus electrode for each group of electron emission cones on a common substrate along with the extraction electrode, such that the focus electrode surrounds the extraction electrode.

18 Claims, 12 Drawing Sheets

ELECTRON BEAM APPARATUS HAVING AN ELECTRON LENS AND A STRUCTURE FOR COMPENSATING FOR A SPHERICAL ABERRATION OF THE ELECTRON LENS

BACKGROUND OF THE INVENTION

1. Field of the Invention P The present invention relates to an electron beam apparatus using a field emission cold cathode device manufactured by, e.g., a thin film technology and, more particularly, to an electron beam apparatus using an electron beam which is focused using an electromagnetic field and modulated by a high-frequency signal.

2. Description of the Prior Art

A field emission cold cathode in which micro-cold cathodes, each constituted by a small conical emitter and an electron extraction electrode formed near the emitter and having a function of extracting a current from the emitter and a current control function, are arrayed has been proposed (Journal of Applied Physics, Vol. 39, No. 7, p. 3504, 1968). FIGS. 1A to 1D show the structure of this field emission cold cathode. Referring to FIGS. 1A and 1B, reference numeral 101 denotes a silicon substrate; and 102, an insulating layer of silicon oxide. An electron extraction electrode 103 is stacked on the insulating layer 102. Parts of the insulating layer 102 and electron extraction electrode 103 are removed, and emitters 104 each having a sharp distal end are formed in these removed surface portions on the silicon substrate 101. The emitter 104, the electron extraction electrode 103, and the cavity formed in the insulating layer 102 constitute a micro-cold cathode 107. A lot of micro-cold cathodes 107 are arrayed to form a cold cathode 108 having an electron emission region.

FIG. 1C is a sectional view showing one of the micro-cold cathodes 107 constituting the cold cathode 108. This cold cathode 108 can obtain a higher current density or smaller velocity distribution in the electron emission direction than that of a conventional hot cathode.

Application of such a field emission cold cathode to the electron sources of various electron beam apparatuses is proposed. When the field emission cold cathode is applied to a cathode ray tube or the like, the fluorescent screen or phosphor screen is spaced apart from the cold cathode by several tens of cm. An electron beam is emitted from the emitter toward the fluorescent screen, focused into a predetermined beam diameter or less through an electromagnetic lens system, and impinged onto the fluorescent screen to cause the phosphor to emit light, thereby displaying a desired image.

When the field emission cold cathode is used as the electron source of an electron beam apparatus, electrons are emitted from the emitter with a certain divergent angle. Therefore, in an application to a cathode ray tube or the like using a focused electron beam, no sufficiently small beam diameter can be obtained. Alternatively, a large-diameter electron lens capable of minimizing spherical aberration is required to obtain a sufficiently small beam diameter, resulting in a bulky apparatus. Various measures have been proposed to solve this problem.

According to measurements by the present inventors, electrons emitted from the field emission cold cathode has a divergent angle of 20° to 30° in terms of half angle with respect to the emission direction. The main reason for this is that the potential distribution near the distal end of the emitter 104 is greatly distorted by the sharpness of the emitter 104 to generate, in the electrons, horizontal velocity components perpendicular to the emission direction. This horizontal velocity component generated due to distortion of the potential distribution is unique to the field emission cold cathode in which electrons are emitted from an emitter with a sharp distal end. In the conventional hot cathode, electrons are emitted from a flat cathode and contain no such extreme horizontal velocity components. The electrons emitted from the hot cathode have thermal velocity components in random directions that are determined by the cathode temperature, although the magnitudes of these components do not pose any practical problem in an application to a cathode ray tube or the like.

Electrons having horizontal velocity components degrade the characteristics of equipment or a device using an electron beam. In an application to a flat display device, the phosphor of an adjacent pixel is caused to emit light, thus degrading the resolution or color purity. In an application to a camera tube, the electron beam cannot be sufficiently focused, so that high resolution cannot be obtained.

To solve these problems, an examination has been made to reduce the divergent angle of the electron beam with a structure using a deflection electrode or focusing electrode to repel the electrons.

FIG. 1D shows a prior art approach disclosed in Japanese Unexamined Patent Publication No. 5-242794 in which the field emission cold cathode is constituted by stacking an insulating layer 105 and a focusing electrode 106 on the electron extraction electrode 103 shown in FIG. 1C. Normally, a voltage lower than that of the electron extraction electrode 103 is applied to the focusing electrode 106 to decelerate the electrons, thereby suppressing the divergence of the electron beam. Alternatively, a voltage lower than that of the emitter 104, i.e., a negative voltage is applied to the focusing electrode 106 to focus the electron beam by an electrostatic repelling force.

Japanese Unexamined Patent Publication No. 5-343000 discloses a technique of forming a multi-stage ring-shaped electrode around the emitter group to surround the emitter region, as shown in FIG. 2. An electron gun 140 is formed on a insulating substrate 134 or Si or glass on a ceramic substrate 133. Insulating layers 136, electron extraction electrodes 137, emitter holes 138, and emitters 139 are formed on a cathode conductive member 135. A plate-like conductive member 142 is connected to the electron extraction electrode 137. The conductive member 142 is connected to a gate stem 143 extending through the ceramic substrate 133. An insulating layer 144 is formed on the conductive member 142. An electron beam focusing electrode 145 having a 0.5- to 0.6-mm hole 145*a* is formed on the insulating layer 144. A second electron beam focusing electrode 148 is formed on the electron beam focusing electrode 145 via a 0.1- to 0.2-mm ceramic insulating member 147.

Upon operation, the emitter 139 is grounded, a voltage of 30 to 150 V is applied to the electron extraction electrode, a voltage of 0 to 150 V is applied to the first electron beam focusing electrode 145, and a voltage of 200 to 500 V is applied to the second electron beam focusing electrode 148.

There are techniques of controlling focusing of the electron beam by a circuit in a conventional picture tube. In one technique, a voltage synchronized with the deflection coil current is applied to a quadrupole lens electrode inserted between the focusing electrodes of the picture tube, thereby always maintaining an optimum focusing state independently of the beam position on the fluorescent screen.

Another technique optimally corrects the focusing state in accordance with changes in luminance. Japanese Unexamined Patent Publication No. 52-18547 discloses a technique of supplying a signal having a given voltage ratio to that applied to the cathode to a fifth grid 150 as one of electrodes constituting the main lens, as shown in FIG. 3. With this technique, variations in crossover position according to current modulation are converted into the power of the main lens to always obtain an optimum focused beam spot.

Japanese Unexamined Patent Publication No. 7-85812 discloses a technique of applying a voltage for modulating the electron beam current to a correction electrode inserted between the focusing electrodes of the picture tube, as shown in FIG. 4. Referring to FIG. 4, a correction electrode 151 is inserted to improve focusing of an electron beam and arranged between a first acceleration electrode 152 and a focusing electrode 153 while being spaced apart from these electrodes by an equal distance. A voltage for current modulation is amplified and applied to the correction electrode 151. Depending on the voltage applied to the correction electrode, the focusing condition of a main electrostatic lens 154 is optimally corrected in accordance with the amplitude of a luminance modulation signal to be supplied to a cathode 155.

In the technique disclosed in Japanese Unexamined Patent Publication No. 50-146264, an electrode and a sub (second) grid 156 to which a voltage changing in accordance with a change in electron beam current is applied are arranged between arbitrary electrodes of the picture tube (CRT) electron gun, thereby suppressing an increase in beam spot size due to an increase in electron beam current, as shown in FIG. 5.

In the driving technique disclosed in Japanese Unexamined Patent Publication No. 5-266806, a predetermined focusing characteristic is obtained independently of the magnitude of the voltage to be applied to the electron extraction electrode, i.e., independently of the magnitude of the electron beam to be emitted in a field emission cold cathode having a focusing electrode as shown in FIG. 1D.

When the conventional field emission cold cathode is applied to a cathode ray tube or the like, the following problems are posed.

Upon focusing of a divergent electron beam, in the prior art (FIG. 1D) in which two layers of electron extraction electrodes and focusing electrodes are stacked, electrons emitted from the distal end are bent by the second focusing electrode having a positive potential. Particularly, when the divergent angle increases, the electrons collide against the focusing electrode.

To solve this problem, the diameter of the upper focusing electrode is increased to prevent collision of the electrons, or the difference between the electron extraction electrode voltage and the focusing electrode voltage is reduced to minimize the bend of electrons. However, these measures degrade the focusing effect. In addition, since electrons passing near the upper focusing electrode travel while being strongly attracted by the gate, the electrons have a large divergent angle at the anode.

Furthermore, since the focusing electrode voltage has a value smaller than the electron extraction electrode voltage value, field concentration at the sharp distal end of the emitter is impeded. When a voltage of 70 V is applied to the electron extraction electrode, and a voltage of 20 V is applied to the focusing electrode spaced apart from the electron extraction electrode by 0.5 $\mu$m, a current corresponding to only 15% to 20% of a current which is emitted with an electron extraction electrode voltage of 70 V in a structure having the electron extraction electrode alone is extracted.

With the focusing electrode structure shown in FIG. 1D, the divergent angle of the electron beam can only be reduced to about 15°. When a sufficient focusing characteristic is to be obtained for an electron beam having such large divergent angle using an electron lens, the electron beam diameter increases due to the spherical aberration of the electron lens. To prevent a degradation in focusing characteristic due to the aberration of the electron lens, the diameter of the electron lens must be increased.

When ring-shaped focusing electrodes are arranged around the emitter region constituted by a plurality of emitters, electrons from the central portion of the emitter region are focused by the focusing electrodes. Near the outermost periphery of the emitter region, however, electrons emitted from an emitter near the outermost periphery are only bent in one direction and not sufficiently focused because the electric field points in one direction toward the center. Particularly, when the emitter region is large, the number of devices at the periphery becomes larger than that at the center in proportion to the length of the circumference of the emitter region. Therefore, all emission currents cannot be sufficiently focused only by the plurality of emitters and the focusing electrodes surrounding the emitters. That is, the focusing electrodes having this structure cannot reduce the divergent angle of all electrons emitted from the entire emitter region.

In addition to the above problems in reducing the divergence of the electron beam, a secondary problem is posed. That is, when the focusing electrodes having the above-described various structure are arranged, a relatively large electrostatic capacitance is formed between the emitter and the focusing electrode, so the electron beam emitted upon applying a high-frequency signal between the emitter and the electron extraction electrode can hardly be modulated by a high-frequency signal.

As an application to a cathode ray tube, in cathode ray tubes used for personal computer display devices which are rapidly becoming popular in recent years, the electron beam must be modulated by a signal having a frequency higher than 100 MHz at maximum. In such a case, the electrostatic capacitance between the emitter and the electron extraction electrode or between the emitter and the focusing electrode largely impedes the operation. In the cathode ray tube, normally, the electron extraction electrode is set at the ground potential, and the modulated signal is applied to the emitter, thereby preventing changes in focusing characteristic of the electron lens due to changes in electron beam current. For this reason, when a high-frequency signal is applied to the emitter, a very high power is consumed to charge/discharge the electrostatic capacitance between the emitter and the focusing electrode. In addition, the signal between the emitter and the electron extraction electrode is attenuated so the electron beam current cannot be modulated at a desired amplitude.

SUMMARY OF THE INVENTION

It is an object of the present invention to provide an electron beam apparatus having a field emission cold cathode for forming an electron beam spot focused on a fluorescent screen in an apparatus having an electromagnetic lens between a plurality of emitters and the fluorescent screen even when the emission angle of electrons from the emitters is relatively large.

It is another object of the present invention to provide an electron beam apparatus capable of modulating an electron beam by a high-frequency signal by using a field emission cold cathode having a focusing electrode.

In order to achieve the above objects, according to the basic aspect of the present invention, there is provided an electron beam apparatus which focuses, through an electron lens, electrons emitted from a field emission cold cathode in which a group of a plurality of emitters each having a sharp distal end and an electron extraction electrode are formed on a substrate. The field emission cold cathode to achieve this object causes the highest density portion of an electron orbit to cross a lens plane of the electron lens at a distance from the central point of the lens on the lens plane. An electron orbit is defined as a beam of electrons having a certain thickness and which is formed by electrons emitted from an emitter spaced apart from a central point of an emitter region, where a plurality of emitters are arranged, by a distance r. The lens plane is a plane which is perpendicular to a first plane through the emitter from which the electrons are emitted, the central point of the emitter region, and a central point of the lens. The passage of the electron orbit through the lens plane into a region on an opposite side of the lens from which the electrons are emitted occurs such that a distance between the passage point through the lens plane and the central point of the lens increasing with the distance r.

According to the above aspect of the present invention, the electrode is arranged to surround the emitter group serving as an electron source. A voltage is applied to bend the electrons from the emitter spaced apart from the central portion toward the central portion, so that the electron beam is incident on a position spaced apart from the central portion of the electron lens. For this reason, the spherical aberration of the electron lens can be used to form a small beam image on the fluorescent screen.

In a field emission cold cathode having the conventional structure, when electrons emitted from the emitters have a divergent angle, no sufficiently small beam diameter can be obtained, unlike the hot cathode. According to the present invention, even electrons emitted from a relatively large emitter region can be focused. Therefore, the size of the emitter region can be increased, so that a large current can be extracted.

To obtain the above effect, the field emission cold cathode has a structure in which the focusing electrode is arranged to surround the emitters. Although a large electrostatic capacitance is formed between the emitter and the focusing electrode, the electron beam can be modulated by a high-frequency signal with a driving circuit arrangement for maintaining a predetermined potential difference between the focusing electrode and the emitter.

The above and many other objects, features and advantages of the present invention will become manifest to those skilled in the art upon making reference to the following detailed description and accompanying drawings in which preferred embodiments incorporating the principles of the present invention are shown by way of illustrative example.

DETAILED DESCRIPTION OF THE PREFERRED EMBODIMENTS

In a description of a means for solving problems in an electron beam apparatus having a field emission cold cathode of the present invention, a simplified electron beam apparatus having an axially symmetrical shape will be exemplified. More specifically, an emitter region, an electron lens, and a fluorescent screen are arranged to be parallel to each other and rotationally symmetrical with respect to an axis. Actually, a plurality of emitters are not symmetrical with respect to the axis. However, the principle of the present invention can be described considering a plane passing through the symmetrical axis and an emitter of interest.

Figure 1A:
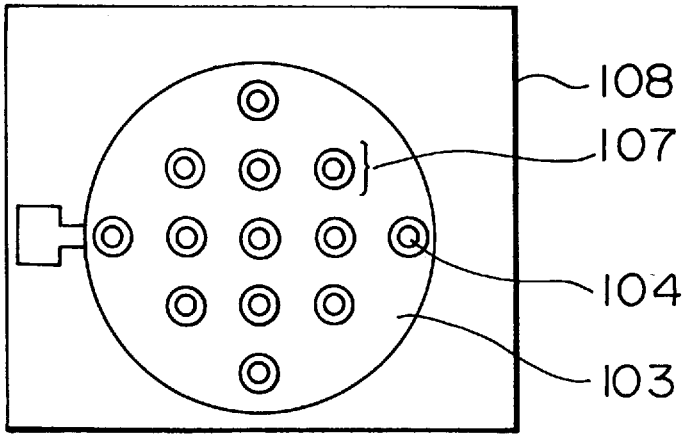
FIG. 1A PRIOR ART
FIG. 1A is a plan view and FIGS. 1B to 1D are sectional views showing the structure of a conventional field emission cold cathode.
Figure 1B:
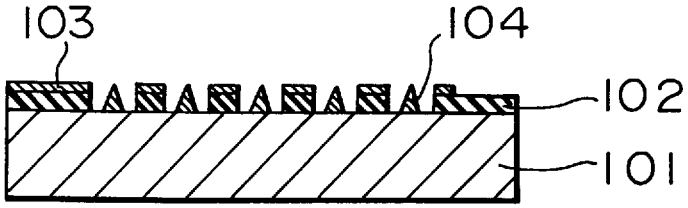
FIG. 1B PRIOR ART
Figure 1C:
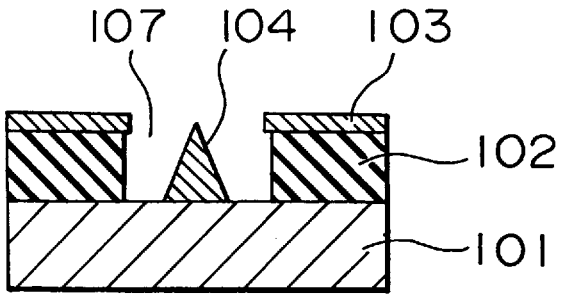
FIG. 1C PRIOR ART
Figure 1D:
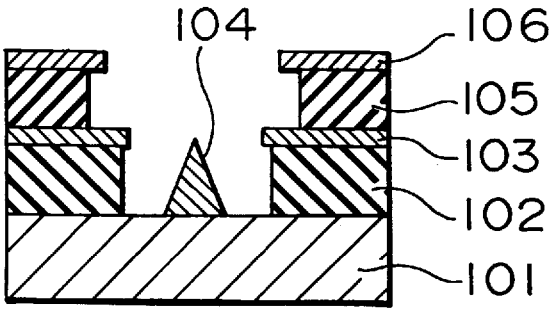
FIG. 1D PRIOR ART
Figure 2:
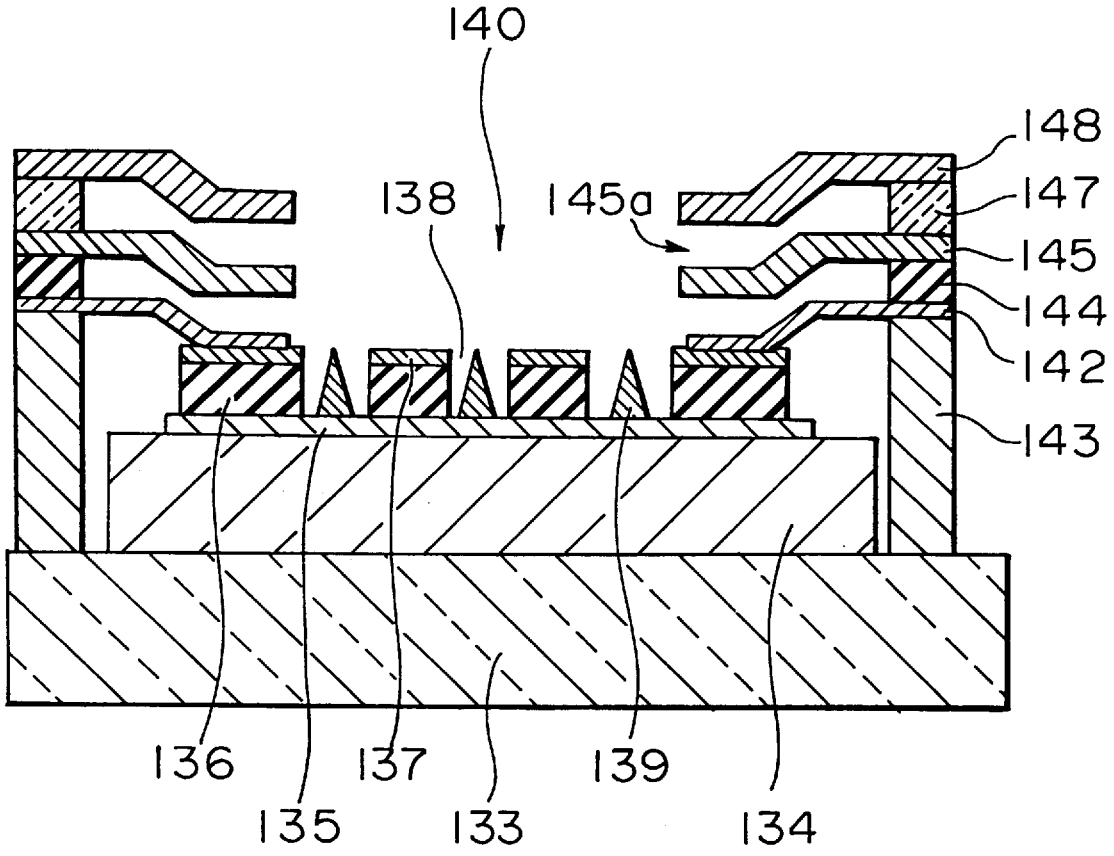
FIG. 2 PRIOR ART
FIG. 2 is a sectional view showing the structure of another conventional field emission cold cathode.
Figure 3:
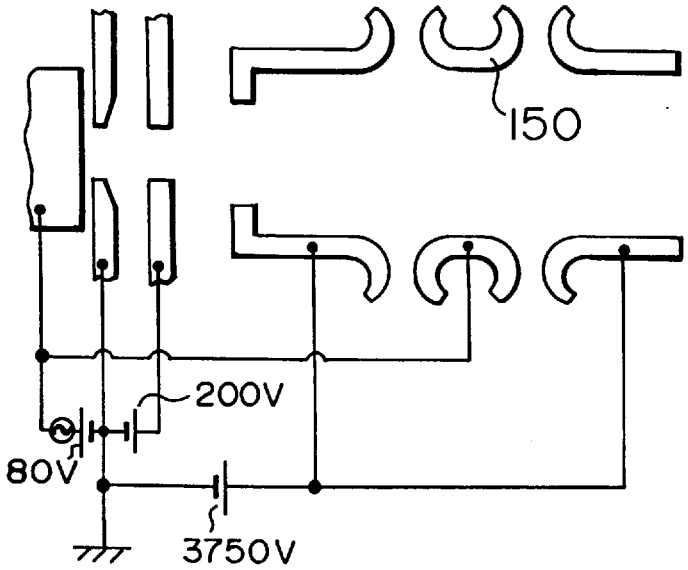
FIG. 3 PRIOR ART
FIG. 3 is a schematic plan view showing the arrangement of a conventional picture tube apparatus.
Figure 4:
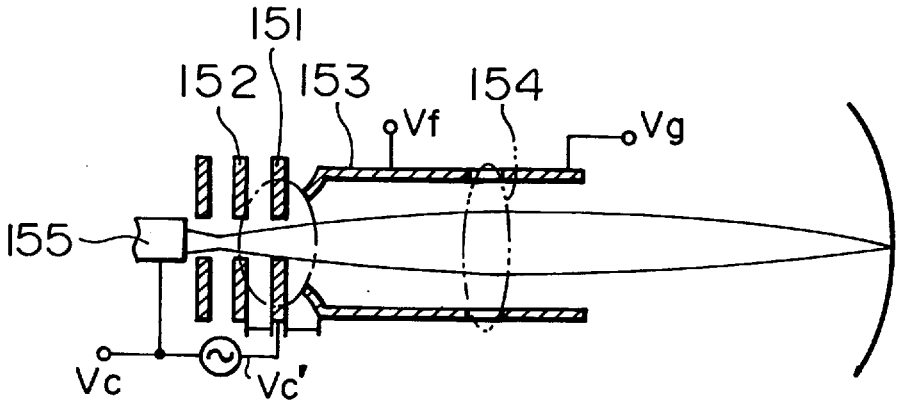
FIG. 4 PRIOR ART
FIG. 4 is a sectional view showing another conventional picture tube apparatus.
Figure 5A:
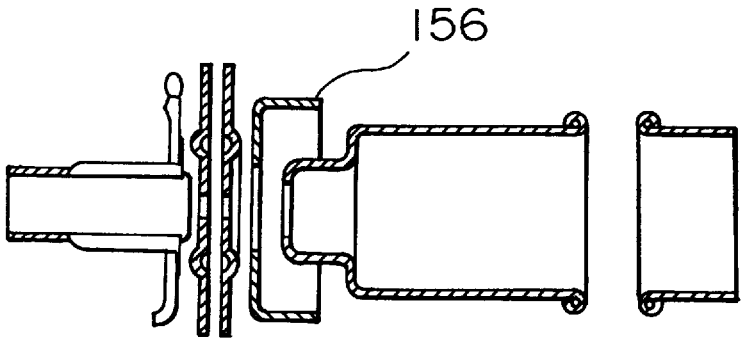
FIG. 5A PRIOR ART
FIGS. 5A and 5B are a schematic diagram showing still another conventional picture tube apparatus and an explanatory view of the electron beam formation process, respectively.
Figure 5B:
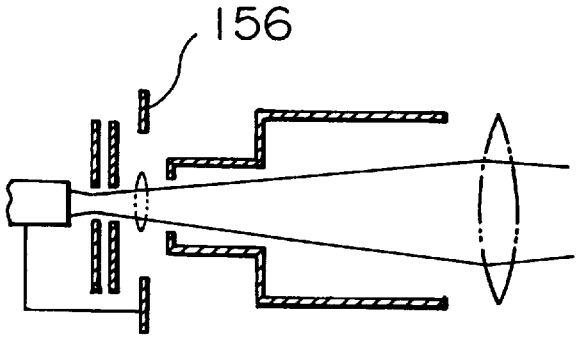
FIG. 5 B PRIOR ART
Figure 6:
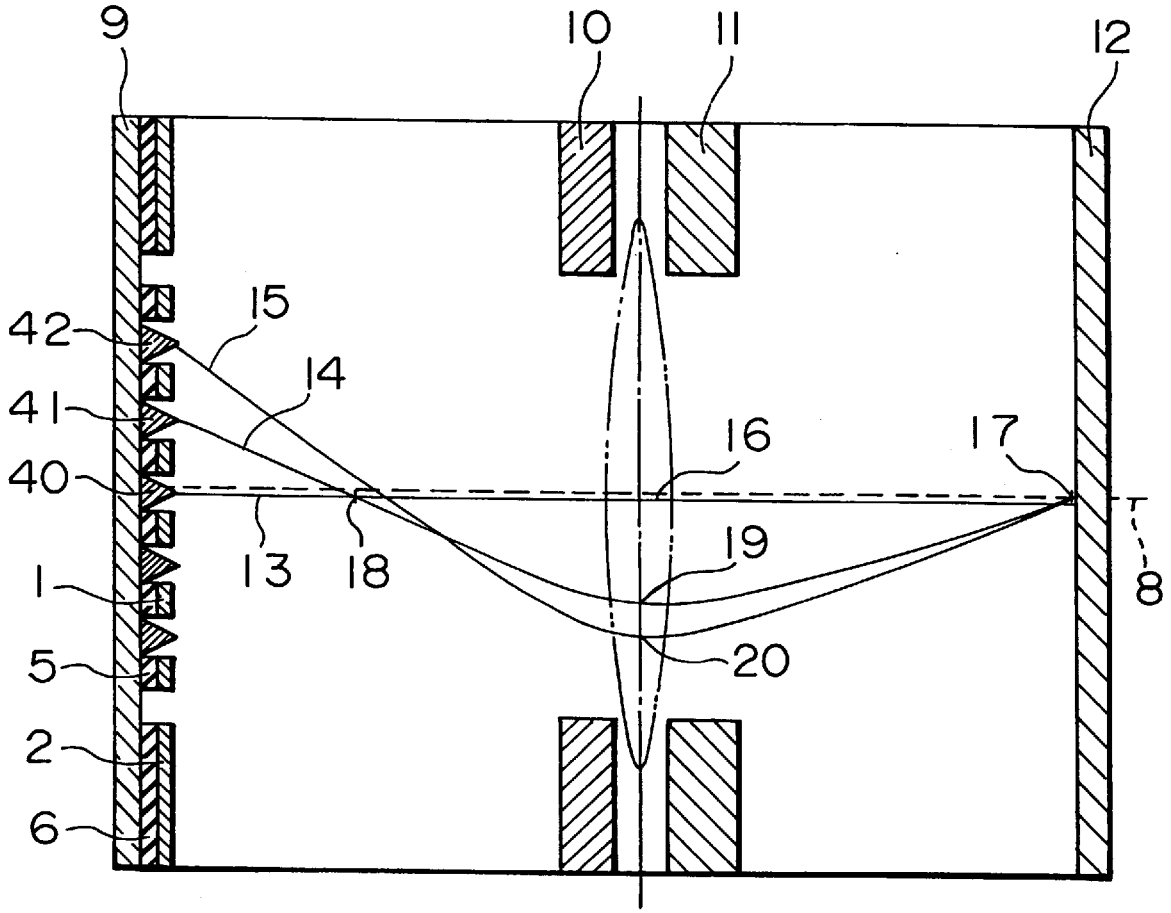
FIG. 6 is a sectional view showing the structure of the first embodiment of the present invention.

FIG. 6 is a sectional view for explaining the principle of the first embodiment of the present invention. More specifically, a plurality of emitters 40, 41, and 42 are arranged on a substrate 9 with respect to an axis 8, i.e., the central axis. The distal end portion of the emitter 40 is on the axis 8. The emitter 41 is slightly spaced apart from the axis 8. The distal end portion of the emitter 42 is further spaced apart from the axis 8. On the substrate 9, a gate electrode 1 is formed via an insulating film 5, and a focusing electrode 2 is arranged around the emitters 40 to 42 via an insulating film 6. Electrodes 10 and 11 are arranged above the emitters. When a voltage of 6 kV is applied to the electrode 10, and a voltage of 25 kV is applied to the electrode 11, an electron lens is formed by the electrodes 10 and 11. Electrons are emitted from the emitters 40, 41, and 42 along orbits 13, 14, and 15, respectively. The orbit 13 passes a position 16 of the electron lens along the symmetrical axis up to a point 17 on a fluorescent screen 12.

The orbit 14 starting from the distal end of the emitter 41 crosses a point 18 on the symmetrical axis, passes a position 19 of the electron lens, i.e., a position lower than the symmetrical axis, and passes the point 17 on the fluorescent screen 12. The orbit 15 starting from the distal end of the emitter 42 crosses a point near the point 18 on the symmetrical axis, passes a position 20 of the electron lens, i.e., a position lower than the position 19, and passes the point 17 on the fluorescent screen 12.

The reason why the electrons from the emitters are focused on the fluorescent screen 12 regardless of the emission points in the emitter region is that the beams from the emitter group are adjusted to compensate for the spherical aberration of the electron lens.

Figure 7:
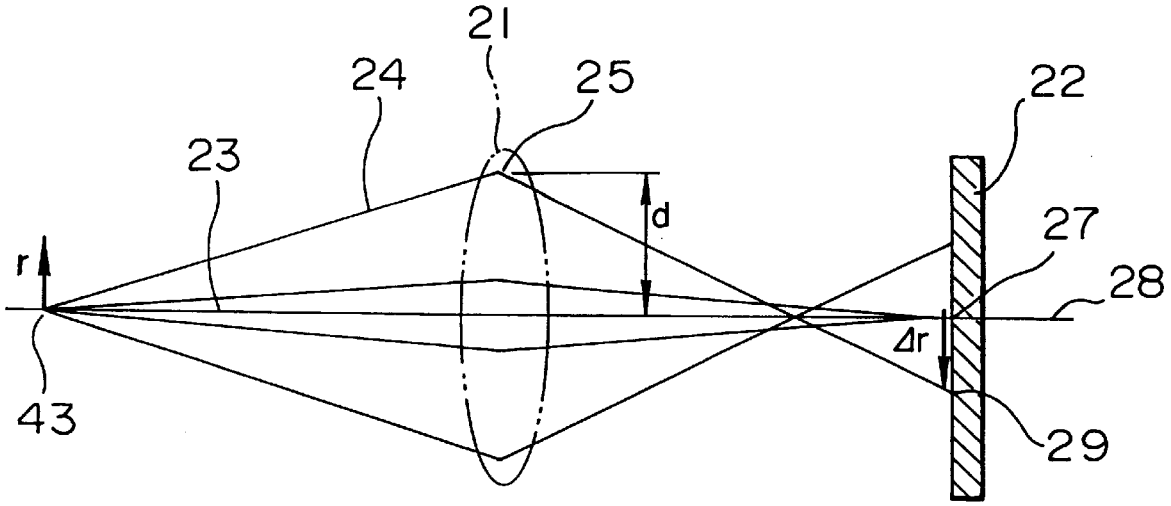
FIG. 7 is a view for explaining the spherical aberration of an electron lens.

FIG. 7 is a schematic view for explaining the spherical aberration of the electron lens. A beam from a point source 43 is focused on a fluorescent screen 22 through a lens 21. Electrons 23 emitted parallel to an optical axis 28 form an image at a point 27 on the fluorescent screen.

On the other hand, electrons 24 emitted from the same point source with a certain angle pass a point 25 on the lens, which is spaced apart from the central axis 28 by a distance d, and reach a point 29 on the fluorescent screen 22. In the electron lens, electrons passing a point spaced apart from the center of the lens have a high refractive index (spherical aberration) and are deflected greatly. Therefore, the focal point shifts by Δr along the axis 28, resulting in a large beam diameteron the fluorescent screen.

In the present invention, the electrons emitted from the emitter spaced apart from the center of the emitter region are caused to pass a point spaced apart from the center of the electron lens. The electrons spaced apart from the center of the lens are further largely bent inward by the spherical aberration of the lens to form an image on the fluorescent screen. Therefore, the electrons emitted from the emitter are focused into the minimum beam diameter on the fluorescent screen.

The electron beam apparatus of the present invention uses a field emission cold cathode in which a focusing electrode for controlling the orbits of electrons is arranged on the emitter substrate at the peripheral portion of the emitter region on almost the same plane as that of the emitter region to surround the emitter region. In addition, this electron beam apparatus uses a field emission cold cathode characterized in that the voltage of the focusing electrode is set to be lower than that of the first gate electrode. As described above, such cold cathode elements have been conventionally proposed, although their objects are to reduce the divergent angle of electrons. In addition, a focusing electrode having such an structure cannot suppress the divergence of electrons.

In the present invention, the focusing electrode in the field emission cold cathode element is used to change the orbits of electrons emitted from emitters in correspondence with the positions of the emitters. In use under conditions for compensating the aberration of the electron lens, this apparatus can obtain a unique excellent effect of obtaining an electron beam focused on the fluorescent screen, unlike the prior art.

In addition, to modulate the electron beam by a high-frequency signal, the potential difference between the emitter and the focusing electrode is always set to be constant. With this arrangement, this electron beam apparatus drives the field emission cold cathode while always maintaining a state wherein charge/discharge of the electrostatic capacitance between the emitter and the focusing electrode is disabled.

Figure 8A:
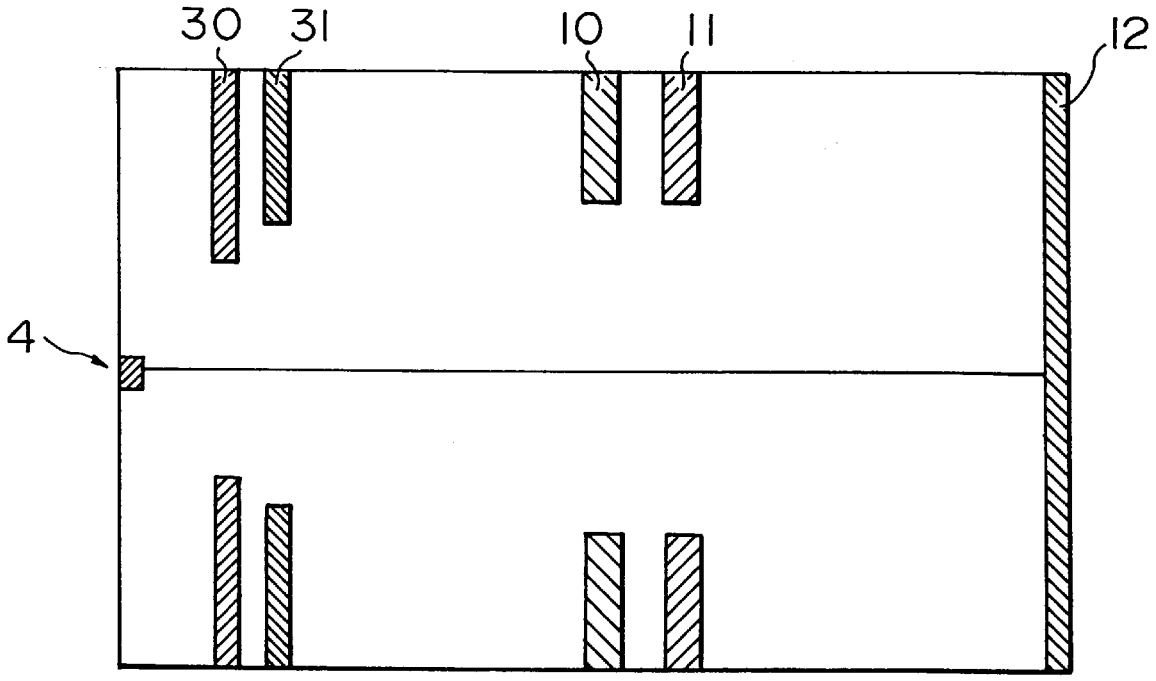
FIGS. 8A and 8B are sectional views showing the main part of the first embodiment of the present invention.
Figure 8B:
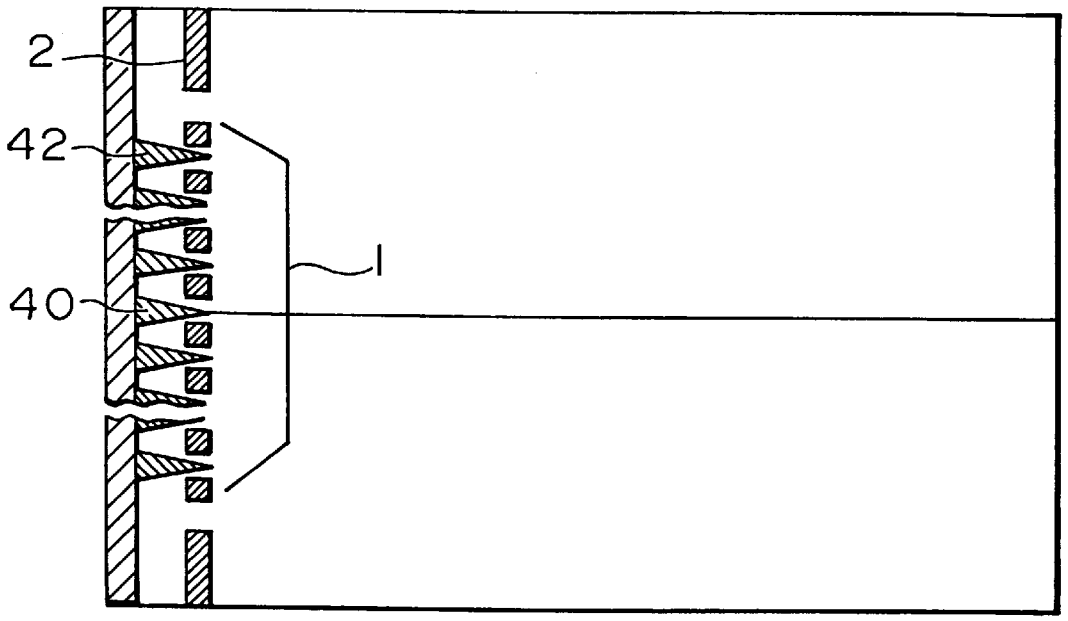

FIGS. 8A and 8B are sectional views of the field emission cold cathode, the electron lens, and the fluorescent screen of the first embodiment of the present invention. FIG. 8A shows the entire structure having a main lens constituted by the electrodes 10 and 11, and the fluorescent screen 12. The voltages of the electrodes 10 and 11 are 6.25 kV and 25 kV, respectively. The interval between the electrodes 10 and 11 is 0.8 mm, and the hole diameters are 0.4 mm.

Figure 9:
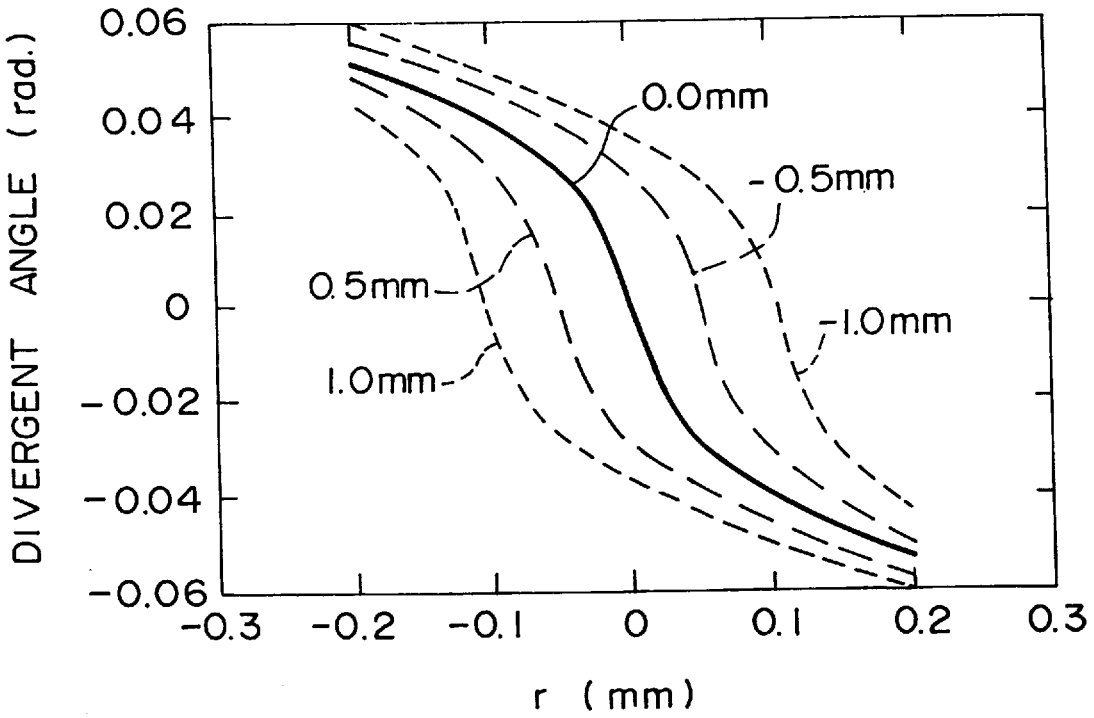
FIG. 9 is a phase-space diagram showing the acceptance of a lens at the virtual crossover point of a main lens according to the first embodiment of the present invention.

A beam diameter Δr has a characteristic represented by an equation below:

$$\Delta r = Mr + C(r + Zk^*(dr/dz))^3$$

where r is the size of the main lens beam source, M is the magnification of the lens, C is the spherical aberration coefficient, and Zk is the distance between the beam source and the main lens (M is about 9 x, and Zk is 24 mm), and dr/dz is the gradient of electrons at the virtual crossover point of the main lens. FIG. 9 is a phase-space diagram showing the acceptance of the lens at the virtual crossover point of the main lens. Numbers in FIG. 9 denote beam diameters on the fluorescent screen.

The apparatus shown in FIG. 8A also has an auxiliary lens consisting of electrodes 30 and 31. This auxiliary lens is arranged to effectively reduce the distance between the electron gun and the main lens and support the effect of the focusing electrode. The distance between the emitter and the electrode 30 is 0.7 mm, the thicknesses of the electrodes 30 and 31 are 0.1 mm and 0.6 mm, respectively, and the distance between the electrodes is 0.45 mm. The hole diameters of the electrodes 30 and 31 are 0.5 mm and 0.7 mm, respectively. A voltage of 270 V and a voltage of 6.25 kV are applied to the electrodes 30 and 31, respectively. FIG. 8B is a view showing a portion near the emitter. The sectioned cones near the emitter 40 in FIG. 8B represent positions where a lot of emitters similar to the emitter 40 are present. The distal end portion of the emitter 40 is positioned at the center of the circular emitter region. The distal end portion of the emitter 42 is positioned on the outermost periphery of the emitter region and spaced apart from the center by 25 μm. The electrode 1 is an electron extraction electrode of the emitters 40 to 42. The focusing electrode 2 having a ring shape is arranged to surround the electron extraction electrode 1.

When a voltage of 70 V is applied to the electron extraction electrode 1 to cause the emitters to emit electrons, the image of the beam is formed on the fluorescent screen, as shown in FIG. 6.

Figure 10:
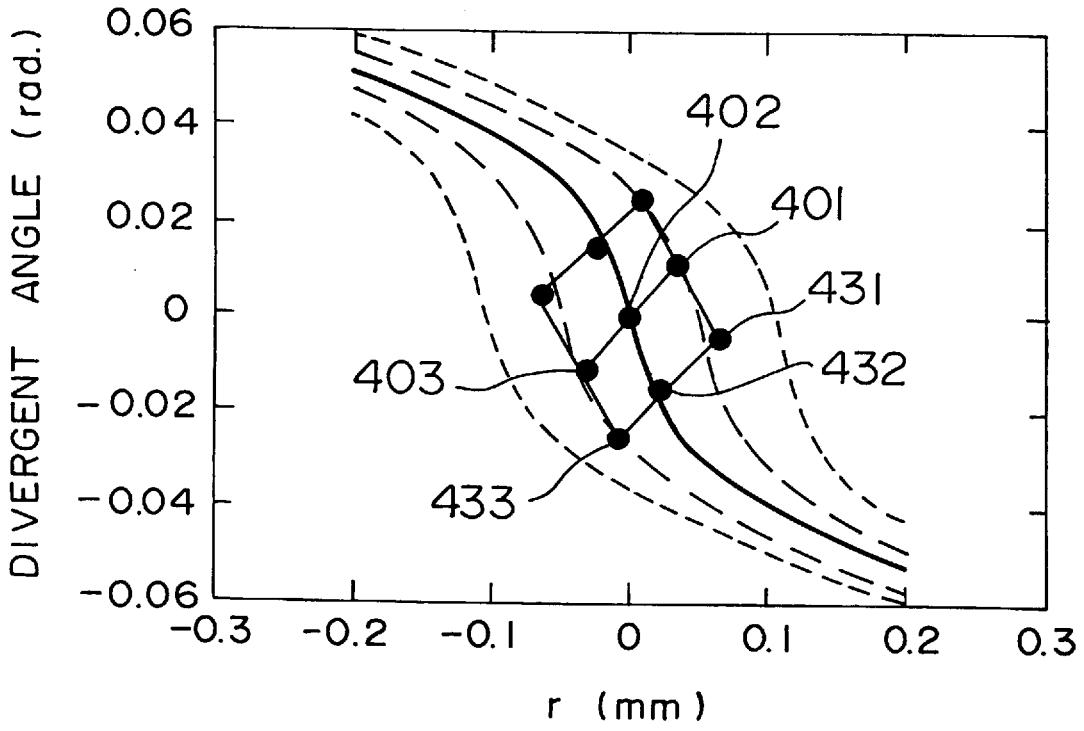
FIG. 10 is a phase-space diagram showing the emittance and acceptance at a main lens light source position, which are observed when a voltage of 50 V is applied to a focusing electrode.
Figure 11:
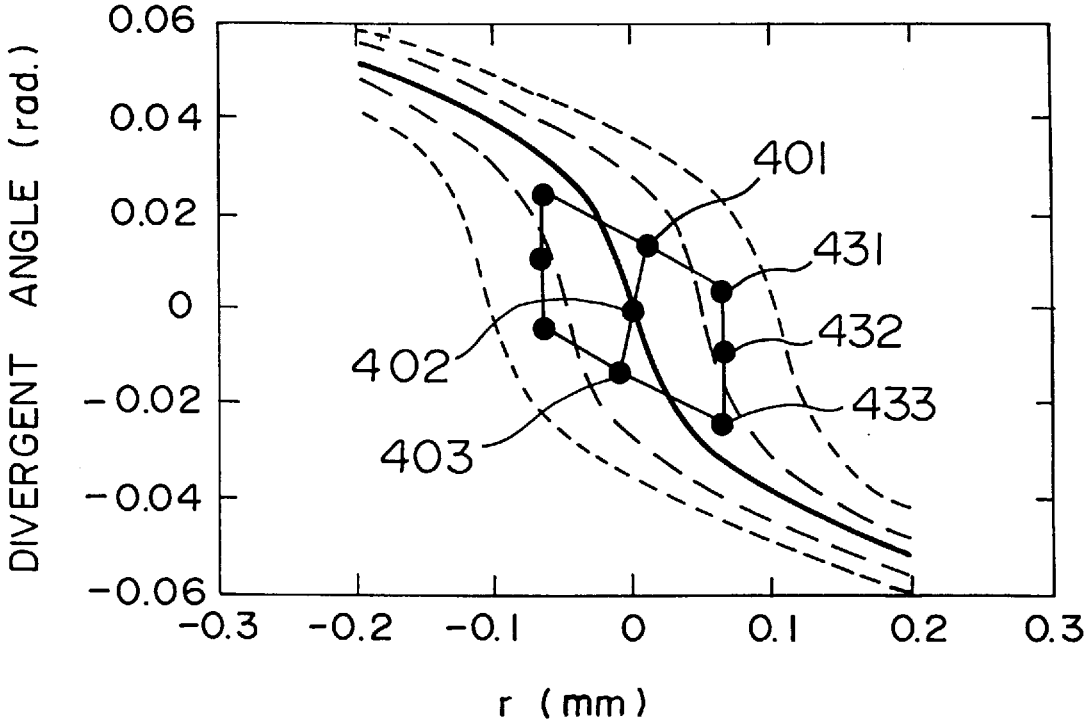
FIG. 11 is a phase-space diagram showing the emittance and acceptance at the virtual crossover point of the main lens, which are observed when the focusing electrode potential is 70 V.

FIG. 10 shows the emittance and acceptance at the main lens light source position, which are observed when a voltage of 50 V is applied to the electron extraction electrode 1. In FIG. 10, reference numerals 401, 402, and 403 denote the orbits of electrons emitted from the emitter 40 with angles of +20°, 0°, and −20°, respectively, and on the other hand, reference numerals 431, 432 and 433 denote the orbits of electrons emitted from the emitter 43 with angles +20°, 0°, and −20°, respectively. As is apparent from FIG. 10, the electrons are focused into a size slightly larger than the beam diameter ±0.5 mm on the fluorescent screen. FIG. 11 shows the emittance and acceptance at the virtual crossover point of the main lens, which are observed when the focusing electrode potential is 70 V. The emittance is larger than the acceptance, i.e., 0.5 mm, and the beam diameter on the fluorescent screen is about 0.7 mm. When the electrons spaced apart from the center of the emitter cross the central axis and pass a point spaced apart from the center of the lens, the orbits of the electrons are bent inward greatly because of the refractive index higher than that at the central portion. For this reason, the electrons form an image on the fluorescent screen, and the beam diameter becomes small.

A method of driving the field emission cold cathode in the electron beam apparatus of the present invention will be described below.

Figure 12:
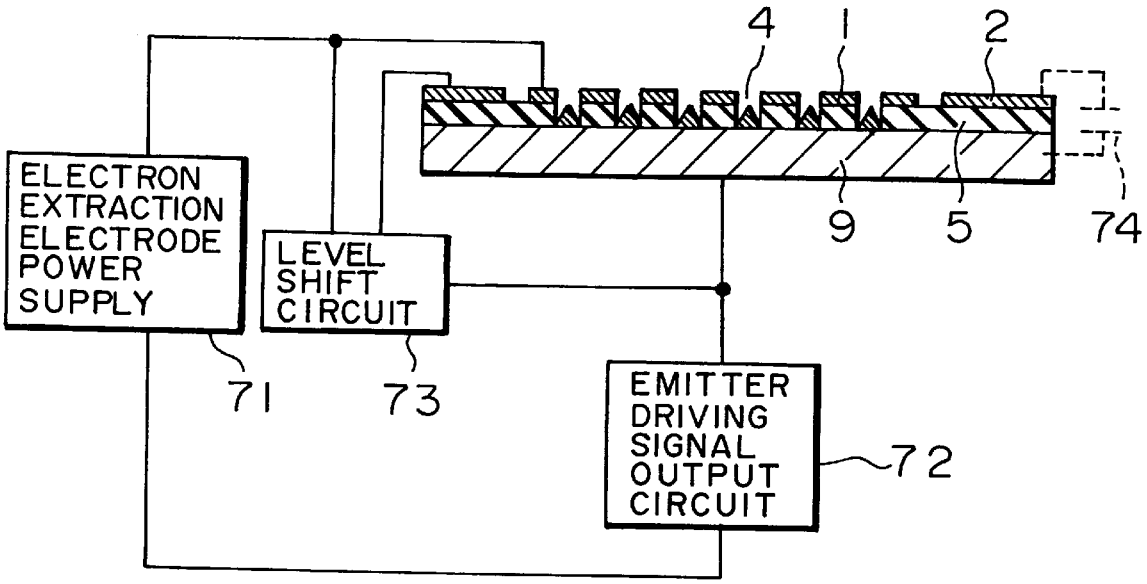
FIG. 12 is a block diagram showing the arrangement of a driving circuit for a field emission cold cathode according to the second embodiment of the present invention.
Figure 15:
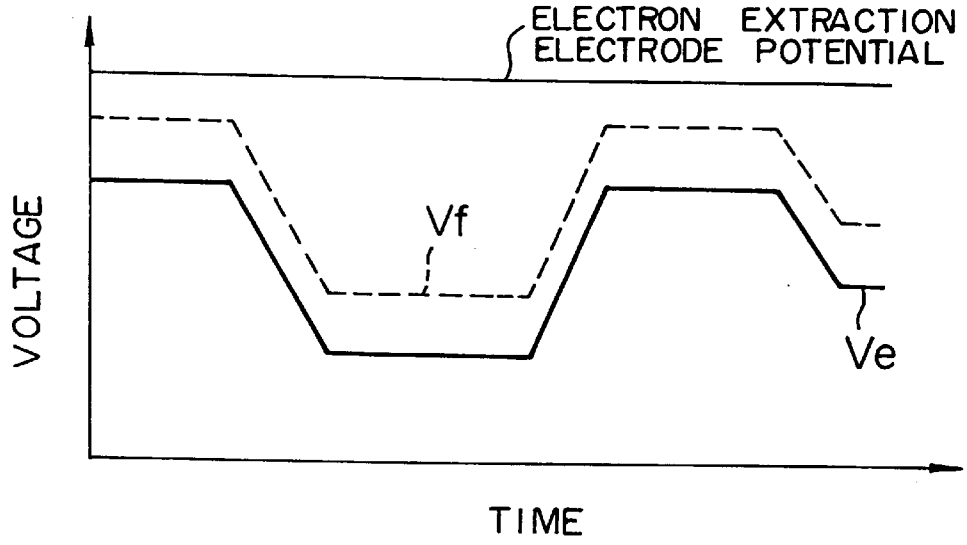
FIG. 15 is a graph showing the waveform of the operation signal of the driving circuit for the field emission cold cathode according to the second embodiment of the present invention.

FIG. 12 is a block diagram showing a driving circuit for the field emission cold cathode in an electron beam apparatus according to the second embodiment of the present invention. FIG. 15 shows the signal waveform in operation. Referring to FIG. 12, reference numeral 71 denotes an electron extraction electrode power supply; 72, an emitter driving signal output circuit; 73, a level shift circuit; 4, an emitter; 2, a focusing electrode; and 74, an electrostatic capacitance between the emitter and the focusing electrode. When a signal Ve shown in FIG. 15 is input to the emitter 4 through a substrate 9, a voltage Vf shown in FIG. 15, which is higher than the emitter voltage Ve by a predetermined potential difference, but lower than the potential of the electron extraction electrode 1, is applied from the level shift circuit 73 to the focusing electrode 2.

The voltage to be applied to the focusing electrode changes in accordance with the emitter driving signal in terms of absolute value. However, since the potential difference between the emitter and the focusing electrode is constant, the electrostatic capacitance 74 between the emitter and the focusing electrode is not charged/discharged. Even when the emitter potential of the field emission cold cathode changes in accordance with the signal from the driving signal output circuit, the potential difference between the emitter and the focusing electrode is constant because of the voltage difference between the input and output terminals of the level shift circuit 73. This means that the rapid change in voltage between the electron extraction electrode and the emitter of a field emission cold cathode 70 is not hampered by the electrostatic capacitance between the emitter and the focusing electrode.

Figure 14:
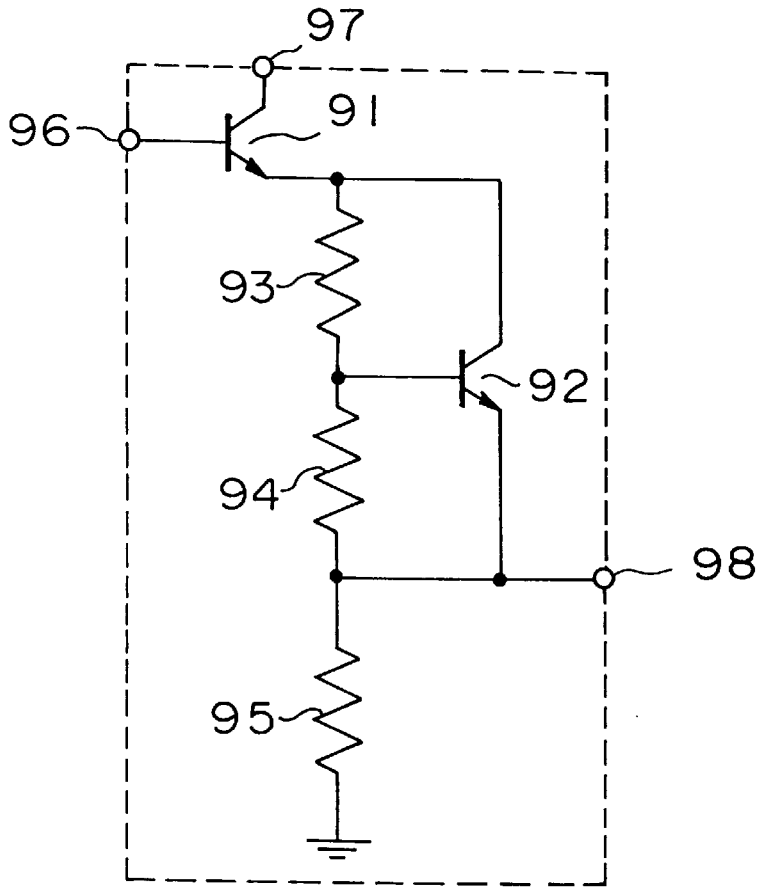
FIG. 14 is a circuit diagram showing a level shift circuit used in the second and third embodiments of the present invention.

As the level shift circuit, a circuit shown in FIG. 14 can be used. In the circuit shown in FIG. 14, a voltage lower than the voltage at an input voltage terminal 96 by a collector-emitter voltage $V_{ce92}$ of a transistor 92 is applied to an output voltage terminal 98 through the emitter follower of a transistor 91. When the base-emitter voltage of the transistor 92 is represented by $V_{be92}$, and the resistance values of resistors 93 and 94 are represented by R93 and R94, respectively, the collector-emitter voltage $V_{ce92}$ of the transistor 92 is always held at a value corresponding to the base-emitter voltage $V_{be92}$ multiplied by a constant determined by the resistance values R93 and R94, as is given by equation (1) below:

$$V_{ce92}=V_{be92}*(R93+R94)/R94 \quad (1)$$

The collector-emitter voltage $V_{ce92}$ changes in accordance with temperature. However, voltage changes at the temperature of the use environment of the electron beam apparatus using a cathode ray tube are about ±5%. Although the potential difference between the focusing electrode voltage Vf and the emitter voltage Ve also changes within the range of about ±5%, it does not largely affect the electron orbit characteristics of the field emission cold cathode 70. Therefore, a desired level shift circuit can be obtained with a simple circuit arrangement.

Figure 13:
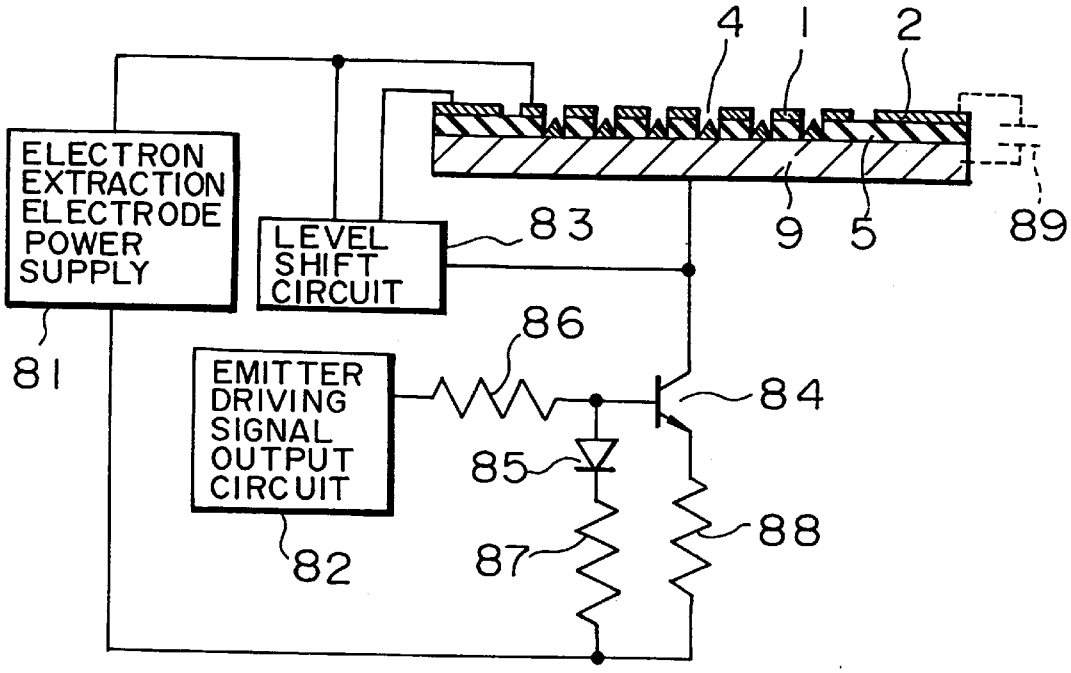
FIG. 13 is a block diagram showing the arrangement of a driving circuit for a field emission cold cathode according to the third embodiment of the present invention.

In the third embodiment of the present invention, another driving circuit including the driving scheme of the present invention will be described below with reference to FIG. 13. Referring to FIG. 13, reference numeral 82 denotes a driving signal output circuit; 81, an electron extraction electrode power supply; 84, a transistor; 85, a diode; 86 to 88, resistors; 4, an emitter; 1, an electron extraction electrode; and 2, a focusing electrode.

In FIG. 13, the transistor 84 constitutes a general constant-current circuit and adds a current stabilizing function for an electron beam emitted from a field emission cold cathode 80. The diode 85 has a function as cancelling the change in the base-emitter forward voltage drop of the transistor 84 with the change of operation temperature. Assume that a voltage signal V1 is input from the driving signal output circuit 82. When the resistance values of the resistors 86 to 88 are represented by R86, R87, and R88, respectively, the collector current of the transistor 84, i.e., an electron beam current Ib of the field emission cold cathode 80 is constant-current-controlled in accordance with equation (2) below:

$$Ib=(V1*R87)/((R86+R87)*R88) \quad (2)$$

When the potential difference between the electron extraction electrode and the emitter in the field emission cold cathode 80 is represented by $V_{ge}$, the voltage applied to the electron extraction electrode power supply input terminal is represented by $V_g$, and the collector-emitter voltage of the transistor 84 is represented by $V_{ce84}$, equation (3) below holds:

$$V_{ge}=V_g-V_{ce84} \quad (3)$$

Control is performed by the transistor 84 such that a potential difference for giving the electron beam current Ib of the field emission cold cathode 80 represented by equation (2) is applied between the electron extraction electrode and the emitter of the field emission cold cathode 80. In the field emission cold cathode 80, random current variations are observed in the emitted electron beam. In this point as well, the field emission cold cathode 80 is poorer in characteristics than the conventional hot cathode. However, the third embodiment also includes the function of stabilizing the current. When the voltage to be applied to the focusing electrode is represented by Vf, the voltage generated by a level shift circuit 83 is represented by $V_{sft}$, and the collector-emitter voltage of the transistor 84 is represented by $V_{ce84}$, equation (4) below holds:

$$Vf=V_{ce84}+V_{sft} \quad (4)$$

As in the second embodiment, the potential difference from the collector potential of the transistor 84, i.e., the emitter electrode potential of the field emission cold cathode 80 is always constant. Even when the frequency of an output signal from the driving signal output circuit 82 is high, the electrostatic capacitance between the emitter and the focusing electrode is not charged/discharged, so the high-frequency characteristics do not degrade, as in the second embodiment. As the level shift circuit, the circuit shown in FIG. 14 can be used, as in the second embodiment.

What is claimed is:

1. An electron beam apparatus comprising:

an associated group of electron emitters which are of the field emission cold cathode type;

an electron extraction gate electrode formed on a substrate along with said electron emitters and controlling field emission of electrons from said electron emitters;

a focus electrode formed around a periphery of said group of electron emitters in substantially the same plane as said gate electrode; and an electron lens for focussing electrons emitted from said electron emitters onto a target.

2. The electron beam apparatus recited in claim 1, said electron lens lying along a plane which is substantially parallel to and spaced apart from said group of electron emitters, between said group of electron emitters and the target.

3. The electron beam apparatus recited in claim 2, further comprising an auxiliary lens lying along a plane which is substantially parallel to and spaced apart from said group of electron emitters, between said group of electron emitters and the target.

4. The electron beam apparatus recited in claim 3, wherein said auxiliary lens comprises:

a first auxiliary lens electrode and a second auxiliary lens electrode, said first and second auxiliary lens electrodes being disposed along respective planes which are substantially parallel to one another;

wherein said first and second auxiliary lens electrodes are supplied with different voltages.

5. The electron beam apparatus recited in claim 1, wherein said electron lens comprises:

a first electron lens electrode and a second electron lens electrode, said first and second electron lens electrodes being disposed along respective planes which are substantially parallel to one another;

wherein said first and second electron lens electrodes are supplied with different voltages.

6. The electron beam apparatus recited in claim 1, further comprising:

an emitter signal source connected to said electron emitters to supply said electron emitters with a common emitter voltage; and a focus signal source connected to said focus electrode to supply said focus electrode with a focus voltage;

wherein the difference between said common emitter voltage and said focus voltage is a constant value.

7. An electron beam apparatus comprising:

an associated group of electron emitters which are of the field emission cold cathode type;

an electron extraction gate electrode formed on a substrate along with said electron emitters and controlling field emission of electrons from said electron emitters;

an electron lens for focussing electrons emitted from said electron emitters onto a target; and means for compensating for a spherical aberration of said electron lens.

8. The electron beam apparatus recited in claim 7, said electron lens lying along a plane which is substantially parallel to and spaced apart from said group of electron emitters, between said group of electron emitters and the target.

9. The electron beam apparatus recited in claim 8, further comprising an auxiliary lens lying along a plane which is substantially parallel to and spaced apart from said group of electron emitters, between said group of electron emitters and the target.

10. The electron beam apparatus recited in claim 9, wherein said auxiliary lens comprises:

a first auxiliary lens electrode and a second auxiliary lens electrode, said first and second auxiliary lens electrodes being disposed along respective planes which are substantially parallel to one another;

wherein said first and second auxiliary lens electrodes are supplied with different voltages.

11. The electron beam apparatus recited in claim 7, wherein said electron lens comprises:

a first electron lens electrode and a second electron lens electrode, said first and second electron lens electrodes being disposed along respective planes which are substantially parallel to one another;

wherein said first and second electron lens electrodes are supplied with different voltages.

12. The electron beam apparatus recited in claim 7, wherein said means for compensating provides a focus potential in such a manner that the electron emission paths of particular ones of the electron emitters which are at or near the periphery of the group are altered substantially more than are the electron emission paths of particular ones of the electron emitters which are at or near a center of the group.

13. The electron beam apparatus recited in claim 7, wherein said means for compensating is formed on the substrate along with said electron extraction gate electrode and said electron emitters.

14. An electron beam apparatus comprising: an associated group of electron emitters which are of the field emission cold cathode type;

an electron extraction gate electrode formed on a substrate along with said electron emitters and controlling field emission of electrons from said electron emitters;

a focus electrode formed around a periphery of said group of electron emitters in substantially the same plane as said gate electrode;

an electron lens for focussing electrons emitted from said electron emitters onto a target; and a current stabilizing circuit connected so as to receive an emitter driving signal output from an emitter driving signal output circuit and connected to provide a driving potential to said associated group of electron emitters.

15. The electron beam apparatus of claim 14, wherein said current stabilizing circuit comprises:

a transistor, a collector of said transistor being connected to said electron emitters via said substrate, and an emitter of said transistor being connected to a common node via a first resistor;

a diode, one end of said diode being connected to a base of said transistor, and the other end of said diode being connected to said common node via a second resistor;

wherein said base of said transistor is connected to said emitter driving signal output circuit via a third resistor so as to receive said emitter driving signal.

16. The electron beam apparatus of claim 15, wherein said transistor is an npn type transistor.

17. The electron beam apparatus of claim 16, wherein the anode of said diode is connected to said base of said transistor.

18. The electron beam apparatus of claim 15, wherein said current stabilizing circuit controls the current of the electrons emitted from said electron emitters, $I_{EMITTED}$, according to the relation $$I_{EMITTED}=(V_{IN}*R_2)/((R_3+R_2)*R_1),$$

where $V_{IN}$ is said emitter driving signal, $R_1$ is the resistance of said first resistor, $R_2$ is the resistance of said second resistor, $R_3$ is the resistance of said third resistor.

* * * * *